US005924393A

United States Patent [19]

Kikuchi

[11] Patent Number: 5,924,393

[45] Date of Patent: Jul. 20, 1999

[54] ENGINE GENERATOR

[75] Inventor: Shinji Kikuchi, Gunma, Japan

[73] Assignee: Sawafuji Electric Co., Ltd., Tokyo, Japan

[21] Appl. No.: 08/925,315

[22] Filed: Sep. 8, 1997

[30] Foreign Application Priority Data

Sep. 10, 1996 [JP] Japan ..... 8-239508

[51] Int. Cl.[6] ..... F02B 63/00

[52] U.S. Cl. ..... 123/2; 290/1 A; 322/1

[58] Field of Search ..... 123/2; 322/1; 290/1 A

[56] References Cited

U.S. PATENT DOCUMENTS 4,698,975 10/1987 Tsukamoto et al. ..... 123/2

4,702,201 10/1987 Odo et al. ..... 123/2

4,914,373 4/1990 Rivkine ..... 322/1

*Primary Examiner*—Noah P. Kamen

*Attorney, Agent, or Firm*—Nikaido, Marmelstein, Murray & Oram LLP

[57] ABSTRACT

In the frame of an engine generator are arranged an engine, a generator adjacent to the engine, and a fuel tank disposed above the generator. A muffler of the engine is disposed on a side of the fuel tank, and a heat shield plate is provided in the frame and interposed between the muffler and the fuel tank. Accordingly, the muffler can be disposed in the vicinity of the fuel tank while avoiding an adverse influence of the radiation of heat from the muffler of the engine on the fuel tank, and the degree of freedom in layout of the engine can be increased.

8 Claims, 6 Drawing Sheets

ENGINE GENERATOR

BACKGROUND OF THE INVENTION

1. Field of the Invention

The present invention relates to an engine generator and, more particularly, to an engine generator in which an engine, a generator adjacent to the engine, and a fuel tank disposed above the generator are arranged in a frame.

2. Description of Related Art

Conventionally, in such an engine generator, a muffler of the engine is disposed at a position relatively distant from the fuel tank in order to avoid an adverse influence of the radiation of heat from the muffler on the fuel tank.

However, if the muffler is disposed at the position distant from the fuel tank in the above-described manner, the degree of freedom in layout of the engine in the engine generator is restricted.

SUMMARY OF THE INVENTION

The present invention has been made in view of the above-described problem, and its object is to provide an engine generator in which the degree of freedom in layout of an engine can be increased by disposing a muffler of the engine in the vicinity of a fuel tank while avoiding the adverse influence of the radiation of heat from the muffler on the fuel tank.

To achieve the above object, according to a feature of the present invention, an engine generator is provided having an engine, a generator adjacent to the engine, and a fuel tank disposed above the generator which are arranged in a frame, wherein a muffler of the engine is disposed on a side of the fuel tank and a heat shield plate provided in the frame so as to be interposed between the muffler and the fuel tank. The adverse influence of the radiation of heat from the muffler on the fuel tank is avoided by the heat shield plate so that the muffler can be disposed in the vicinity of the fuel tank and the degree of freedom in layout of the engine can be increased.

According to another feature of the present invention, the engine generator is further arranged such that a proximal end of a cover which openably and closably covers a top of the engine is rotatably supported on the frame at a position corresponding to an upper end portion of the heat shield plate, and a stopper which holds the cover in its fully-open attitude by engaging with the proximal end of the cover lying at a fully-open position is provided at the top end of the heat shield plate. Accordingly, it becomes unnecessary to provide the frame with a dedicated stopper for holding the cover in the fully-open attitude, and since the fully-open attitude of the cover can be held by using the heat shield plate, the number of parts can be reduced.

The above and other objects, features and advantages of the present invention will become apparent from the detailed description of a preferred embodiment, taken in conjunction with the accompanying drawings.

BRIEF DESCRIPTION OF THE DRAWINGS

FIG. 1 is a side view of an engine generator,

FIG. 2 is a plan view along an arrow 2 in FIG. 1,

FIG. 3 is a front view taken along an arrow 3 in FIG. 1,

FIG. 4 is a sectional view taken along a line 4—4 in FIG. 2,

FIG. 5 is a sectional view of a frame, taken along a line 5—5 in FIG. 2, and FIG. 6 is a sectional view taken along a line 6—6 in FIG. 5.

DESCRIPTION OF PREFERRED EMBODIMENT

Figure 1:
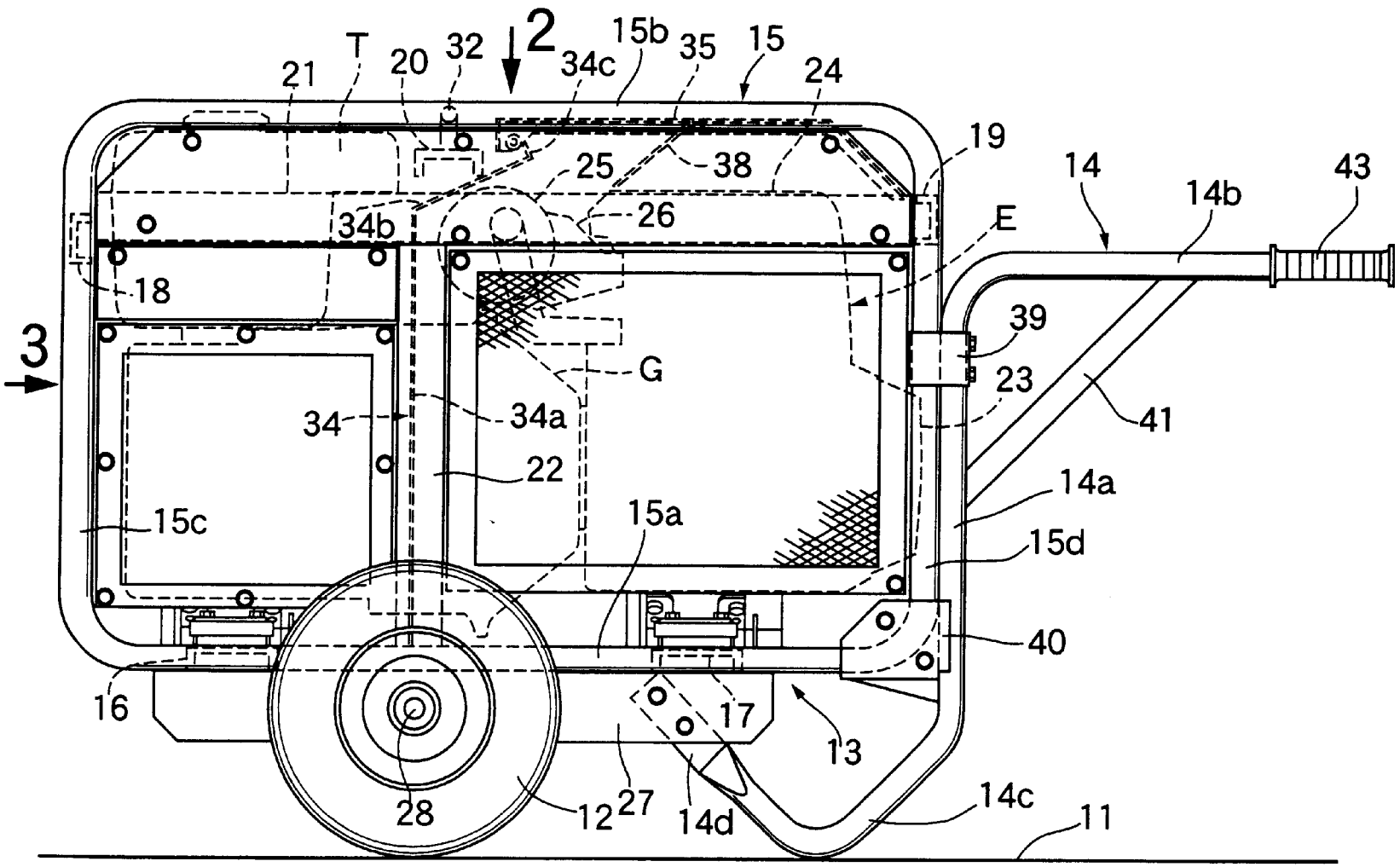
FIGS. 1 through 6 show one embodiment of the present invention.
Figure 2:
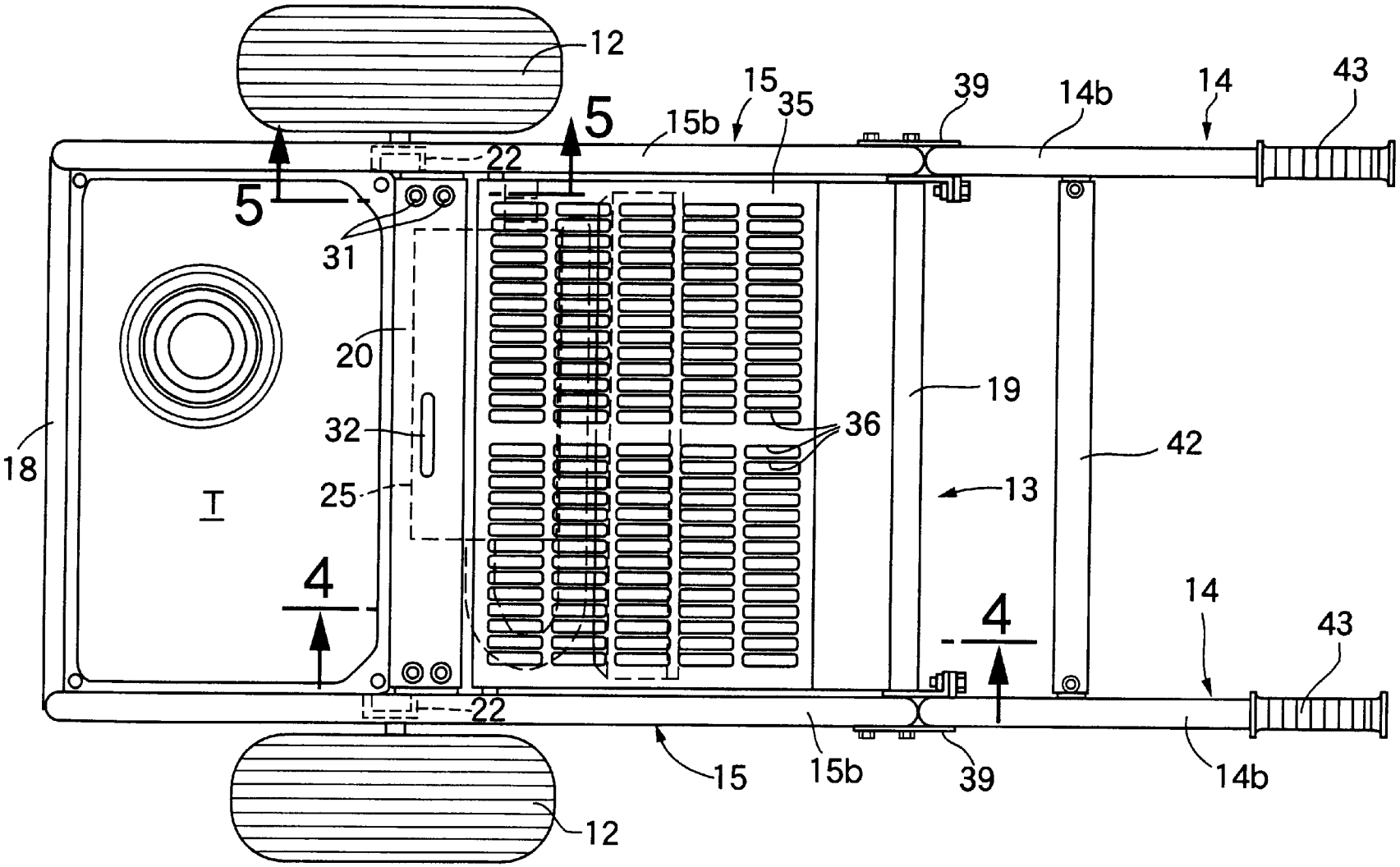
Figure 3:
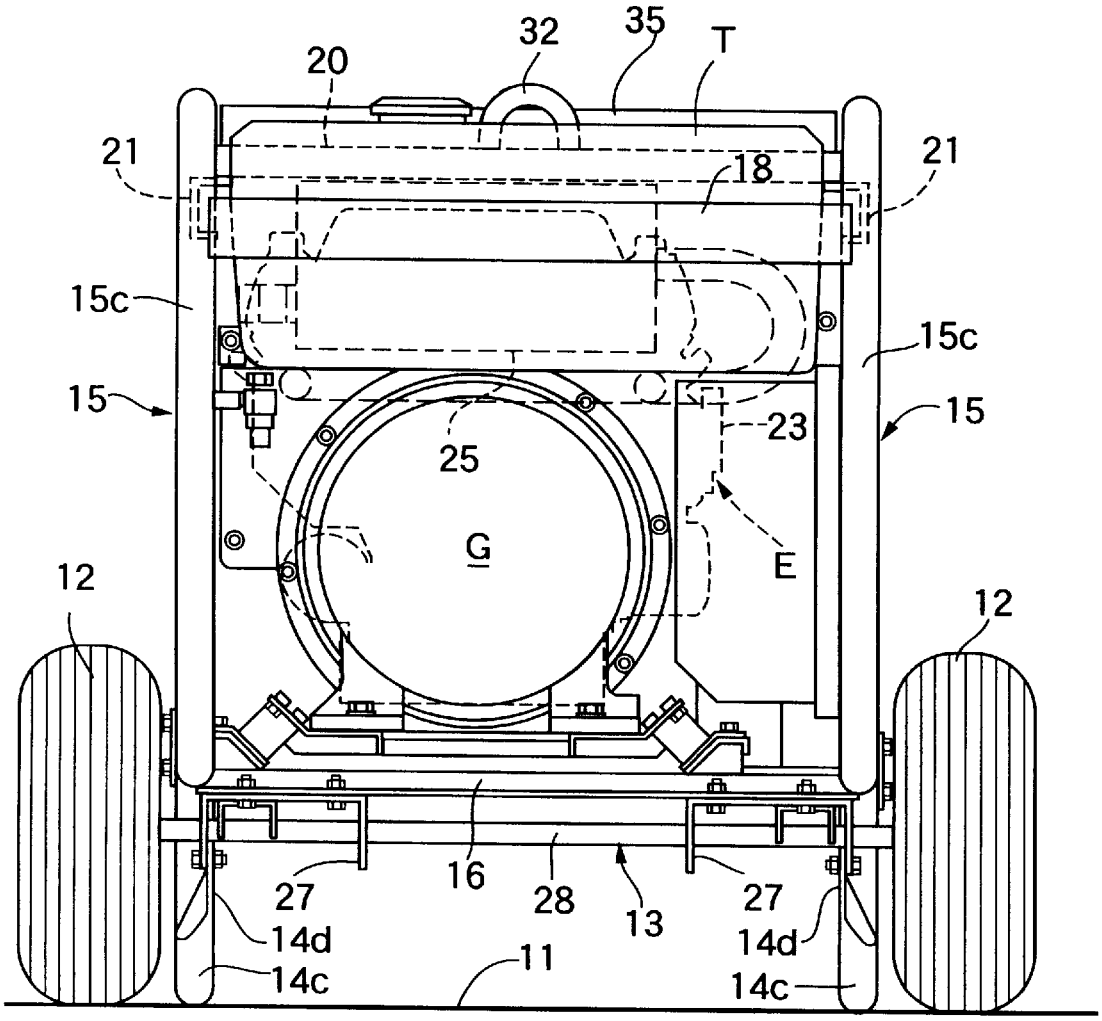

Referring first to FIGS. 1, 2 and 3, this engine generator includes an engine E, a generator G and a fuel tank T all of which are mounted on a frame 13 provided with a pair of left and right wheels 12, 12 which roll on a ground surface 11. The engine generator can be moved on the ground surface 11 by pushing or pulling it while gripping a pair of left and right handles 14, 14 connected to the frame 13.

The frame 13 is provided with a pair of left and right pipe frames 15, 15 each of which is formed by bending a pipe of round section. Each of these pipe frames 15 has a lower horizontal pipe portion 15*a* which extends between the front and the rear of the engine generator, an upper horizontal pipe portion 15*b* which extends above the lower horizontal pipe portion 15*a* between the front and the rear of the engine generator, a front vertical pipe portion 15*c* which extends between the top and the bottom of the engine generator to connect the front ends (the left ends in FIG. 1) of the lower and upper horizontal pipe portions 15*a* and 15*b*, and a rear vertical pipe portion 15*d* which extends between the top and the bottom of the engine generator to connect the rear ends (the right ends in FIG. 1) of the lower and upper horizontal pipe portions 15*a* and 15*b*. Each of the pipe frames 15 is formed in an approximately square shape in a plane perpendicular to the ground surface The frame 13 is provided with, in addition to the above-described pair of left and right pipe frames 15, 15, a pair of front and rear lower cross frames 16 and 17, a pair of front and rear upper cross frames 18 and 19, a center cross frame 20 positioned between both the upper cross frames 18 and 19, a pair of left and right horizontal frames 21, 21, and a pair of left and right vertical frames 22, 22.

The front-side lower cross frame 16 is provided between front portions of the lower horizontal pipe portions 15*a*, 15*a* of both the pipe frames 15,15, and the rear-side lower cross frame 17 is provided between rear portions of the lower horizontal pipe portions 15*a*, 15*a* of both the pipe frames 15,15.

The engine E includes an engine body 23, an air cleaner 24 which constitutes part of an intake system and is disposed on the top portion of the engine body 23, a muffler 25 which constitutes part of an exhaust system, and the like. The engine body 23 is mounted on the rear-side lower cross frame 17. The generator G is connected to a crankshaft (not shown) of the engine body 23 and is mounted on the front-side lower cross frame 16 adjacently to the engine E. Thus, the muffler 25 of the engine E is supported by a bracket 26 provided on the engine body 23 and disposed above the generator G on the side closer to the engine E. The fuel tank T is disposed above the generator G, and the muffler 25 is disposed on one side of the fuel tank T.

A pair of left and right support frames 27 and 27 each of which has a substantially U-shaped cross-sectional shape which is open downward and extends between the front and the rear of the frame 13 are fixed to the lower surfaces of both the front and rear lower cross frames 16 and 17, and axles 28 of both wheels 12, 12 are rotatably supported by both support frames 27, 27.

The front-side upper cross frame 18 is provided between upper portions of the front vertical pipe portions 15*c*, 15*c* of both the pipe frames 15 and 15, and the rear-side upper cross frame 19 is provided between upper portions of the rear vertical pipe portions 15*d,* 15*d* of both the pipe frames 15, 15.

Each of the horizontal frames 21, 21 is provided between the upper portions of the front vertical pipe portion 15*c* and the rear vertical pipe portion 15*d* of each of the pipe frames 15, 15. Each of the vertical frames 22, 22 extends between the top and the bottom of the engine generator to connect the lower horizontal pipe portion 15*a* and the horizontal frame 21 of each of the pipe frames 15, 15 at a position substantially corresponding to the position between the fuel tank T and the muffler 25.

Figure 4:
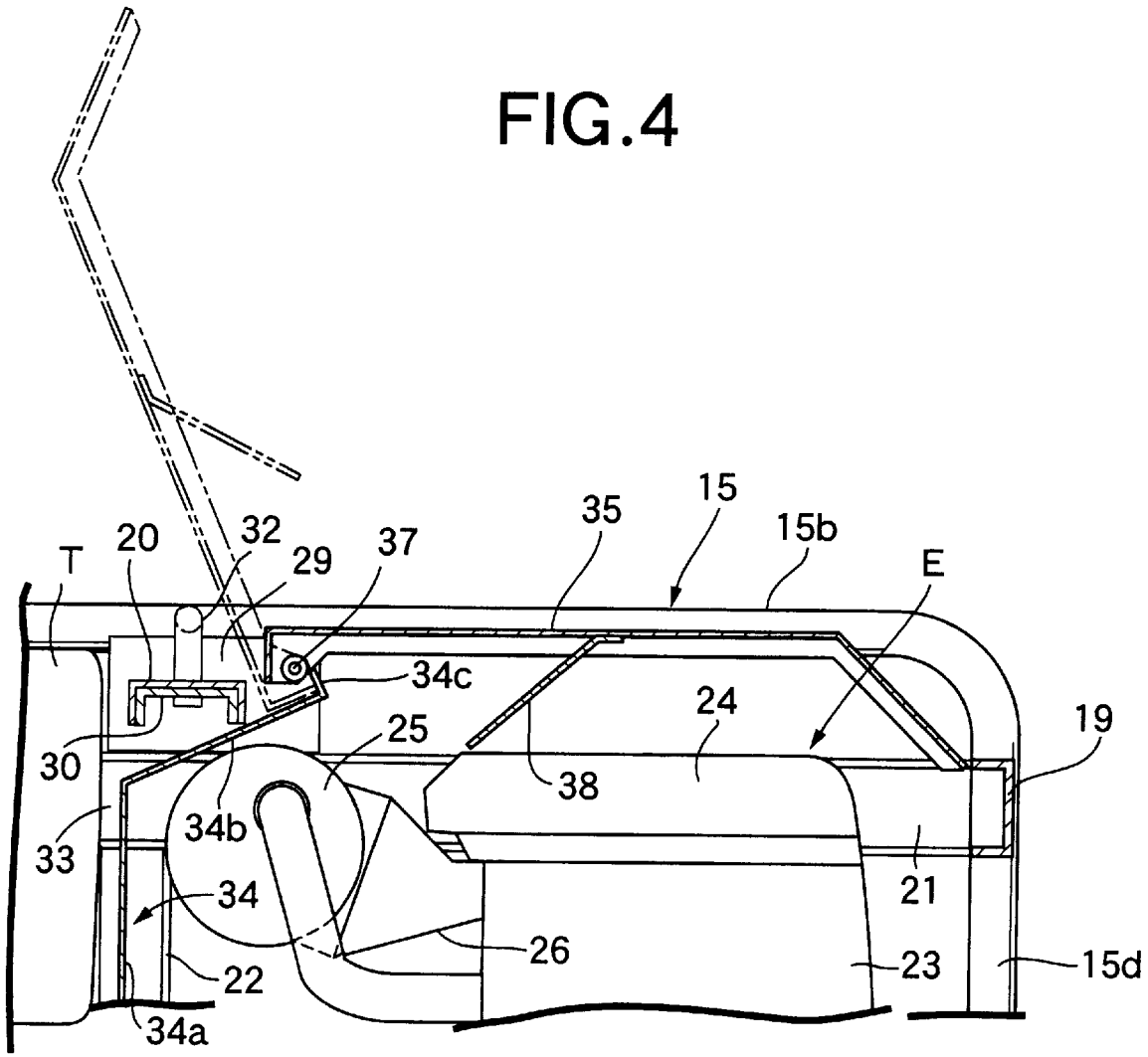
Figure 5:
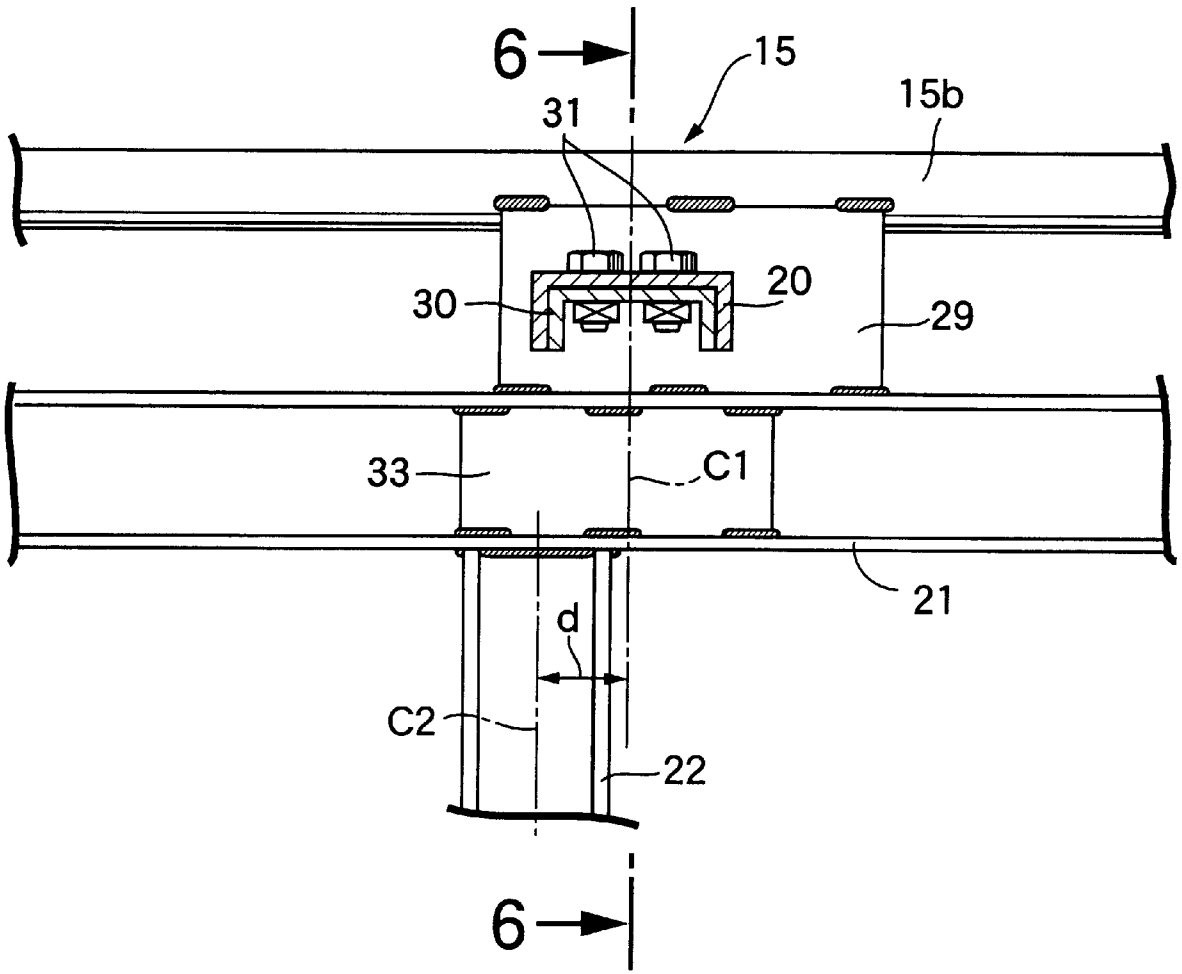
Figure 6:
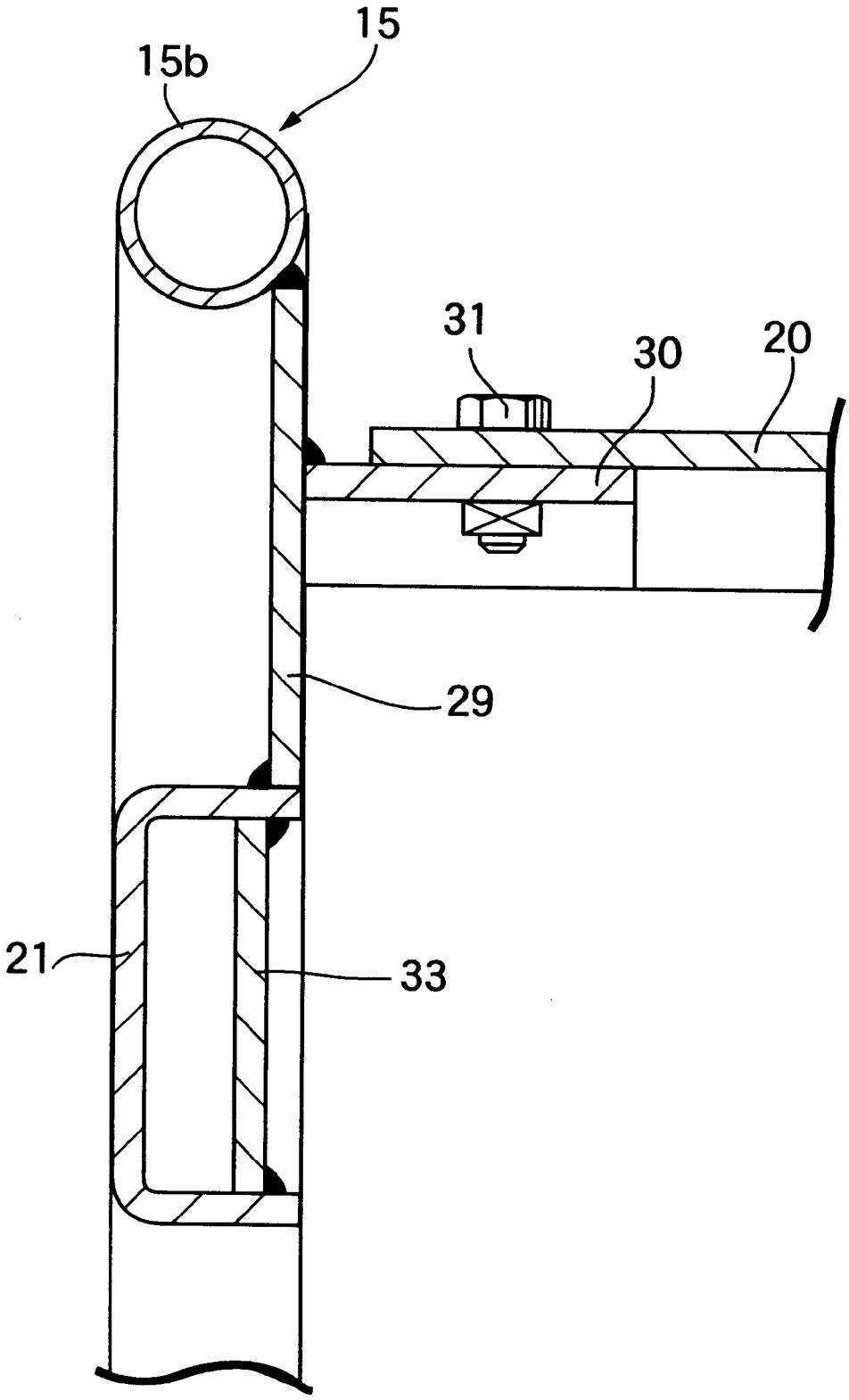

Referring also to FIGS. 4, 5 and 6, connecting plates 29 are respectively provided between the upper horizontal pipe portions 15*b,* 15*b* of both the pipe frames 15, 15 and both the horizontal frames 21, 21 positioned below the upper horizontal pipe portions 15*b,* 15*b*. Support plates 30 which project inward are fixed to the respective connecting plates 29, and both ends of the center cross frame 20 are fastened to the upper surfaces of the support plates 30 with bolts 31, 31, respectively. A substantially U-shaped hanger 32 for suspending the entire engine generator by means of a hoist or the like and loading it onto a truck or the like is fixed to the upper surface of a lengthwise central portion of the center cross frame 20. The positions of the connecting plates 29 having the support plates 30, and the position of the center cross frame 20 connected at both ends to the support plates 30 . . . are determined so that the gravity of center of the entire engine generator exists in a plane which includes the widthwise center C1 of the center cross frame 20.

When the engine generator is suspended by the hanger 32, relatively large loads act on the connecting portions between the respective connecting plates 29 and the horizontal frames 21, 21, but each of the horizontal frames 21, 21 is formed in a substantially U-shaped cross-sectional shape which is open inward. In addition, it is desirable that no deviation occur between widthwise centers C2 of the vertical frames 22, 22 and the widthwise center Cl of the center cross frame 20 so that torsion is prevented from occurring in the horizontal frames 21, 21 by the action of force from the center cross frame 20. However, there may be a case in which each of the vertical frames 22, 22 must be disposed at a position providing a deviation of distance d between the centers C1 and C2 (see FIG. 5), in terms of the layout of the engine E, the generator G and the like.

Therefore, reinforcing plates 33 . . . which respectively form, by cooperating with the horizontal frames 21, 21, square cross-sectional shapes are fixed between the respective connecting portions of the horizontal frames 21, 21 to the vertical frames 22, 22, and the respective connecting portions of the horizontal frames 21, 21 to the center cross frame 20 via the connecting plates 29. With these reinforcing plates 33, it is possible to give both the horizontal frames 21, 21 strengths which can resist the relatively large loads which act on the respective horizontal frames 21, 21 at the connecting portions between the connecting plates 29 and the horizontal frames 21, 21, and it is also possible to give both the horizontal frames 21, 21 strengths which can resist forces in torsional directions due to the occurrence of deviations between the widthwise centers C2 of the respective vertical frames 22, 22 and the widthwise center C1 of the center cross frame 20. Accordingly, it is possible to increase the degree of freedom in layout of the horizontal frames 21, 21.

A heat shield plate 34 is provided in the frame 13 in such a manner as to be interposed between the muffler 25 of the engine E and the fuel tank T. This heat shield plate 34 is provided with a vertical plate portion 34*a* which extends vertically between the fuel tank T and the muffler 25 across or straddling the generator G, an inclined plate portion 34*b* which is connected to the upper end of the vertical plate portion 34*a* to be inclined in a rearward rising manner and is disposed between the center cross frame 20 and the muffler 25, and a stopper 34*c* which is provided continuously with and substantially perpendicularly to the upper end of the inclined plate portion 34*b* and extends in a forward rising manner.

The proximal end of a cover 35 which openably and closably covers the top of the engine E is rotatably supported on the frame 13 by support shafts 37 at a position corresponding to the upper end of the heat shield plate 34, and this cover 35 has a multiplicity of openings 36. The cover 35 is rotatable between a fully-closed position where the cover 35 covers the top of the engine E, as shown by solid lines in FIG. 4 and a fully-open position where the cover 35 opens the top of the engine E, as shown by chained lines in FIG. 4, and the proximal end of the cover 35 which lies at the fully-open position can hold its fully-open attitude by engaging with a stopper 34*c* provided on the upper end of the heat shield plate 34.

The upper end of a shield plate 38 which extends downward toward the front when the cover 35 is at the fully-closed position is fixed to the internal surface of the cover 35, and this shield plate 38 serves to prevent a hot air flow from the muffler 25 and a warm air flow discharged from the generator G from flowing toward the air cleaner 24 when the cover 35 lies at the fully-closed position. Thus, it is possible to prevent a decreasing in engine output due to suction of high-temperature air into the engine body 23 of the engine E.

The pair of left and right handles 14,14 are connected to the rear portion of the frame 13. Each of the handles 14 has a support portion 14*a* which extends vertically along the rear vertical pipe portion 15*d* of the pipe frame 15, a rearward extending portion 14*b* which extends rearward from the upper end of the support portion 14*a,* and a stand 14*c* which is connected to the lower end of the support portion 14*a*. Each of the handles 14 is formed by bending a pipe. The upper and lower ends of the support portion are fixedly connected to the rear portion of the frame 13 by connecting metal members 39 and 40, respectively, and a grip 43 is provided at the rear end of the rearward extending portion 14*b*. The stand 14*c* is formed in a triangular shape which is capable of contacting with the ground surface 11, and the front end of the stand 14*c* is formed as a flat portion 14*d,* which is fastened to the support frame 27.

In this manner, both the handles 14,14 have the stands 14*c,* 14*c* and are fixedly connected to the frame 13, whereby the number of parts can be reduced compared to a type in which a dedicated stand separate from a handle is secured to a frame.

Furthermore, both handles 14,14 are respectively provided with reinforcing members 41 each of which forms a triangle between the support portion 14*a* and the rearward extending portion 14*b,* and a cross member 42 is provided between the rearward extending portions 14*b,* 14*b* of the handles 14,14.

The operation of this embodiment will now be described. Since the heat shield plate 34 provided in the frame 13 is interposed between the muffler 25 of the engine E and the fuel tank T, the adverse influence of the radiation of heat from the muffler 25 on the fuel tank T is avoided by the heat shield plate 34. Thus, it becomes possible to dispose the muffler 25 on one side of the fuel tank T, and to increase the degree of freedom in layout of the engine E.

In addition, at the upper end of the heat shield plate 34, there is provided the stopper 34*c* which engages with the proximal end of the cover 35 and holds the cover 35 in the fully-open attitude when the cover 35 which openably and closably covers the top of the engine E lies at the fully-open position. Accordingly, it becomes unnecessary to provide the frame 13 with a dedicated stopper for holding the cover 35 in the fully-open attitude, and since the fully-open attitude of the cover 35 can be held by using the heat shield plate 34, the number of parts can be reduced.

Although the embodiment of the present invention has been described above, the present invention is not limited to the above-described embodiment and various design modifications can be made without departing from the present invention set forth in the claims.

What is claimed is:

1. An engine generator comprising:

an engine arranged in a frame;

a generator arranged in the frame such that the generator is adjacent to, and in a side-by-side relationship with, the engine;

a fuel tank arranged in the frame such that the fuel tank is disposed above the generator;

a muffler disposed on a side of the fuel tank; and a heat shield plate provided in the frame and interposed between the muffler and the fuel tank, wherein the heat shield plate has a lower portion adjacent the generator;

wherein said generator has a lower height than that of said engine.

2. An engine generator according to claim 1 further comprising:

a cover which openably and closably covers a top of the engine and which is rotatably supported at a proximal end thereof on the frame at a position corresponding to an upper end portion of the heat shield plate; and a stopper provided at the upper end portion of the heat shield plate which holds the cover in a fully-open position by engaging with the proximal end of the cover when the cover is lying in the fully-open position.

3. An engine generator according to claim 2 further comprising a shield plate fixed to the cover which prevents a hot air flow from the muffler and a warm air flow from the generator from flowing toward an air cleaner of the engine when the cover lies at a fully-closed position.

4. An engine generator according to claim 3 further comprising:

a left and a right wheel carried on the frame; and a left and a right handle connected to the frame wherein the left and the right handle each have a stand formed in a triangular shape that contacts with a ground surface when the engine generator is not being moved.

5. An engine generator according to claim 2 further comprising:

a left and a right wheel carried on the frame; and a left and a right handle connected to the frame wherein the left and the right handle each have a stand formed in a triangular shape that contacts with a ground surface when the engine generator is not being moved.

6. An engine generator according to claim 1 further comprising:

a left and a right wheel carried on the frame; and a left and a right handle connected to the frame wherein the left and the right handle each have a stand formed in a triangular shape that contacts with a ground surface when the engine generator is not being moved.

7. An engine generator comprising:

an engine arranged in a frame;

a generator arranged in the frame such that the generator is adjacent to the engine;

a fuel tank arranged in the frame such that the fuel tank is disposed above the generator;

a muffler disposed on a side of the fuel tank:

a heat shield plate provided in the frame and interposed between the muffler and the fuel tank;

a cover which openably and closably covers a top of the engine and which is rotatably supported at a proximal end thereof on the frame at a position corresponding to an upper end portion of the heat shield plate; and a stopper provided at the upper end portion of the heat shield plate which holds the cover in a fully-open position by engaging with the proximal end of the cover when the cover is lying in the fully-open position.

8. An engine generator according to claim 7 further comprising a shield plate fixed to the cover which prevents a hot air flow from the muffler and a warm air flow from the generator from flowing toward an air cleaner of the engine when the cover lies at a fully-closed position.

* * * * *